US011530114B2

(12) United States Patent
Haag et al.

(10) Patent No.: US 11,530,114 B2
(45) Date of Patent: Dec. 20, 2022

(54) METHOD AND AN ARRAGEMENT FOR INSTALLING ELEVATOR GUIDE RAILS INTO AN ELEVATOR SHAFT

(71) Applicant: Kone Corporation, Helsinki (FI)

(72) Inventors: Mikael Haag, Helsinki (FI); Harri Mäkinen, Helsinki (FI)

(73) Assignee: Kone Corporation, Helsinki (FI)

( * ) Notice: Subject to any disclaimer, the term of this patent is extended or adjusted under 35 U.S.C. 154(b) by 359 days.

(21) Appl. No.: 16/916,776

(22) Filed: Jun. 30, 2020

(65) Prior Publication Data

US 2021/0016998 A1 Jan. 21, 2021

(30) Foreign Application Priority Data

Jul. 16, 2019 (EP) ..... 19186410

(51) Int. Cl.
*B66B 19/00* (2006.01)
*B66B 7/02* (2006.01)

(52) U.S. Cl.
CPC ..... *B66B 19/002* (2013.01); *B66B 7/026* (2013.01)

(58) Field of Classification Search
CPC ..... B66B 19/002; B66B 7/026; B66B 7/024
See application file for complete search history.

(56) References Cited

U.S. PATENT DOCUMENTS 7,444,732 B2 * 11/2008 Cruz ..... B66B 19/002 187/408
9,592,997 B2 * 3/2017 Mertala ..... B66B 19/002
9,751,728 B2 * 9/2017 Mertala ..... E04G 3/246
11,358,834 B2 * 6/2022 Haag ..... B66B 7/026
11,365,095 B2 * 6/2022 Haag ..... B66B 7/024
2009/0223751 A1 * 9/2009 Peacock ..... B66B 19/00 187/414
2010/0133048 A1 * 6/2010 Barneman ..... B66B 19/00 187/414
2015/0314993 A1 * 11/2015 Bolme ..... B66B 19/00 52/741.1

(Continued)

FOREIGN PATENT DOCUMENTS

JP H0873153 A 3/1996
JP 2010070296 A 4/2010

(Continued)

OTHER PUBLICATIONS

European Search Report for European Patent Application No. 19186410 dated Mar. 12, 2020.

*Primary Examiner* — Michael A Riegelman
(74) *Attorney, Agent, or Firm* — Harness, Dickey & Pierce, P.L.C.

(57) ABSTRACT

The method comprises installing a lowermost first section of guide rail elements, arranging a movable transport apparatus and a movable transport platform in the shaft, connecting a guide rail element provided with a jointing clamp at each end of the guide rail element to the transport apparatus, moving the transport apparatus with the guide rail element upwards, connecting the guide rail element to an upper end of a row of already installed guide rail elements with a plug-in joint provided by jointing clamps, attaching the guide rail element to a wall of the shaft from the transport platform, moving the transport apparatus downwards in order to fetch a new guide rail element.

14 Claims, 11 Drawing Sheets

(56) References Cited

U.S. PATENT DOCUMENTS

Figure 1:
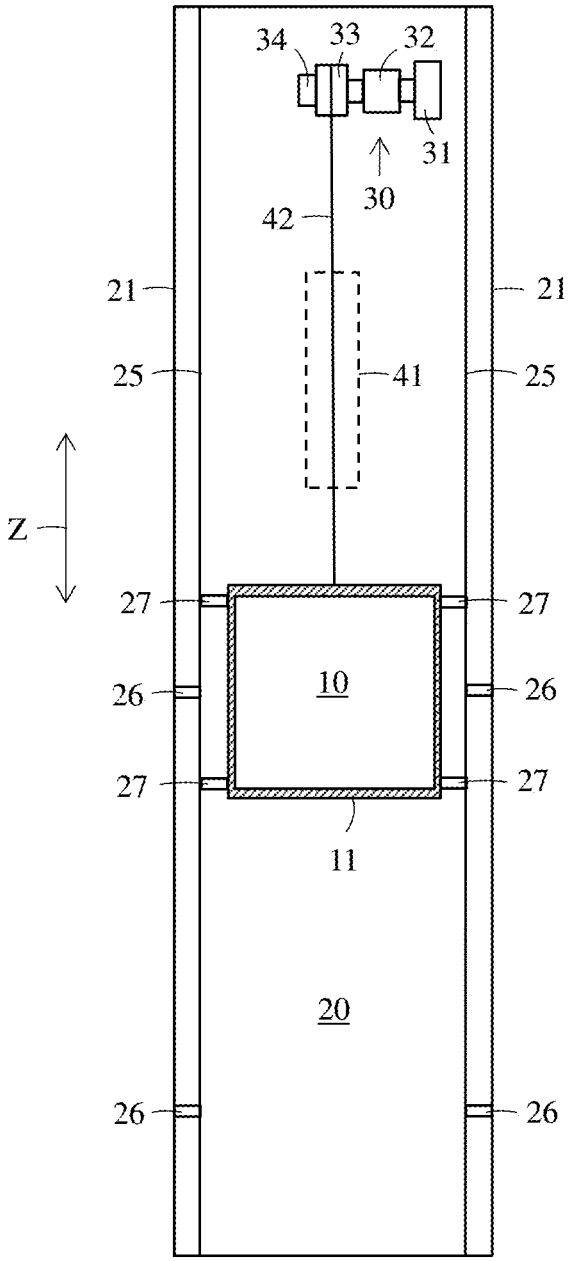

| | | | | |
|---|---|---|---|---|
| 2016/0060078 | A1* | 3/2016 | Mertala | B66B 19/002 52/741.1 |
| 2016/0311659 | A1* | 10/2016 | Mertala | E04G 3/246 |
| 2021/0016994 | A1* | 1/2021 | Haag | B66B 19/002 |
| 2021/0016996 | A1* | 1/2021 | Makinen | B66B 7/023 |
| 2021/0016997 | A1* | 1/2021 | Haag | B66B 7/024 |
| 2021/0016998 | A1* | 1/2021 | Haag | B66B 19/002 |
| 2021/0245998 | A1* | 8/2021 | Lanz | B66B 19/002 |

FOREIGN PATENT DOCUMENTS

| | | | |
|---|---|---|---|
| WO | WO-9829325 | A1 | 7/1998 |
| WO | WO-2018060261 | A1 | 4/2018 |

* cited by examiner

METHOD AND AN ARRAGEMENT FOR INSTALLING ELEVATOR GUIDE RAILS INTO AN ELEVATOR SHAFT

RELATED APPLICATIONS

This application claims priority to European Patent Application No. EP19186410.7 filed on Jul. 16, 2019, the entire contents of which are incorporated herein by reference

FIELD

The invention relates to a method and an arrangement for installing elevator guide rails into an elevator shaft.

BACKGROUND

An elevator may comprise a car, a shaft, hoisting machinery, ropes, and a counterweight. A separate or an integrated car frame may surround the car.

The hoisting machinery may be positioned in the shaft. The hoisting machinery may comprise a drive, an electric motor, a traction sheave, and a machinery brake. The hoisting machinery may move the car upwards and downwards in the shaft. The machinery brake may stop the rotation of the traction sheave and thereby the movement of the elevator car.

The car frame may be connected by the ropes via the traction sheave to the counterweight. The car frame may further be supported with gliding means at guide rails extending in the vertical direction in the shaft. The guide rails may be attached with fastening brackets to the side wall structures in the shaft. The gliding means keep the car in position in the horizontal plane, when the car moves upwards and downwards in the shaft. The counterweight may be supported in a corresponding way on guide rails that are attached to the wall structure of the shaft.

The car may transport people and/or goods between the landings in the building. The wall structure of the shaft may be formed of solid walls or of an open beam structure or of any combination of these.

The guide rails may be formed of guide rail elements of a certain length. The guide rail elements may be connected in the installation phase end-on-end one after the other in the elevator shaft. The guide rail elements may be attached to each other with connection plates extending between the end portions of two consecutive guide rail elements. The connection plates may be attached to the consecutive guide rail elements. The ends of the guide rails may comprise some kind of form locking means in order to position the guide rails correctly in relation to each other. The guide rails may be attached to the walls of the elevator shaft with support means at support points along the height of the guide rails.

The installation of guide rails according to prior art methods involves considerable complexity including transporting, lifting and positioning guide rails in an elevator installation. The time required for a guide rail installation according to prior art methods is also considerable. These problems become even more profound in modern high rise buildings.

SUMMARY

An object of the invention is an improved method and arrangement for installing elevator guide rails into an elevator shaft.

The method for installing elevator guide rails into an elevator shaft according to the invention is defined in claim 1.

The arrangement for installing elevator guide rails into an elevator shaft according to the invention is defined in claim 8.

The invention proposes a simple and cost efficient solution for a complex problem involving transporting, lifting and positioning guide rails in an elevator installation.

The invention makes it possible to shorten the time required for the guide rail installation. The reduction of the time required for the guide rail installation may in some cases be remarkable.

A first lowermost section of guide rails may first be installed manually after which the following sections of guide rails may be installed with a high degree of automation.

The guide rail elements are lifted upwards in the shaft with a first hoist connected to a transport device comprising a hook device and a lever device. The hook device may be attached to an upper end of the guide rail element and the lower end of the guide rail element may be glidingly supported with the lever device on the row of already installed guide rail elements.

The guide rail element may thus be lifted in a controlled manner i.e. the guide rail cannot swing during the lifting.

The lowering of the transport apparatus in order to fetch a new guide rail element is also done in a controlled manner. The lever device may also when moving downwards be glidingly supported on the row of already installed guide rail elements. The hook device may also be glidingly supported on the row of already installed guide rail elements when moving downwards.

The hook device may be fixedly attached to the upper end of the guide rail element during the lifting of the guide rail element.

The transport platform may be used to attach the guide rail element to a wall in the shaft. This may be done manually by a technician or automatically by a robot from the transport platform.

DRAWINGS

Figure 2:
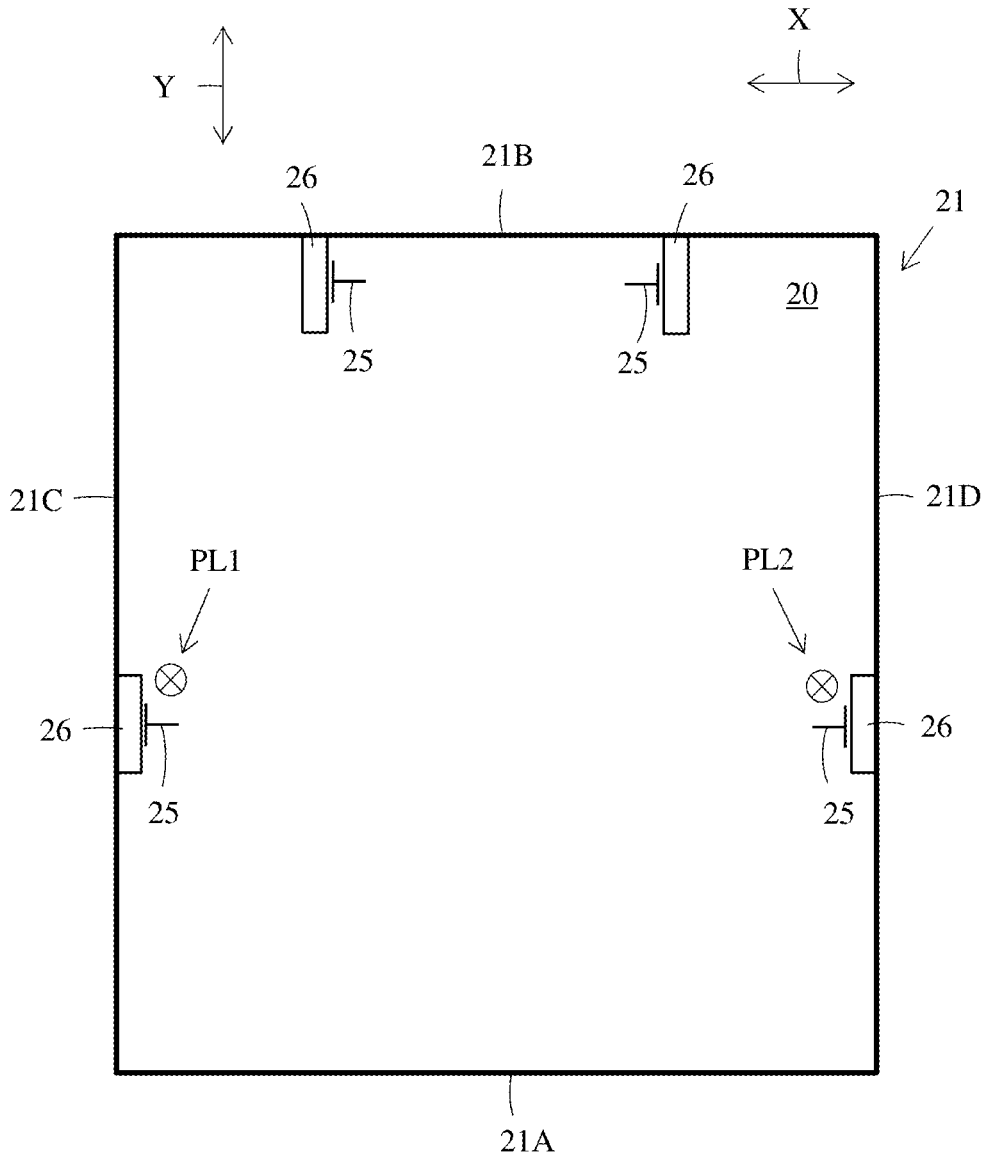
Figure 3:
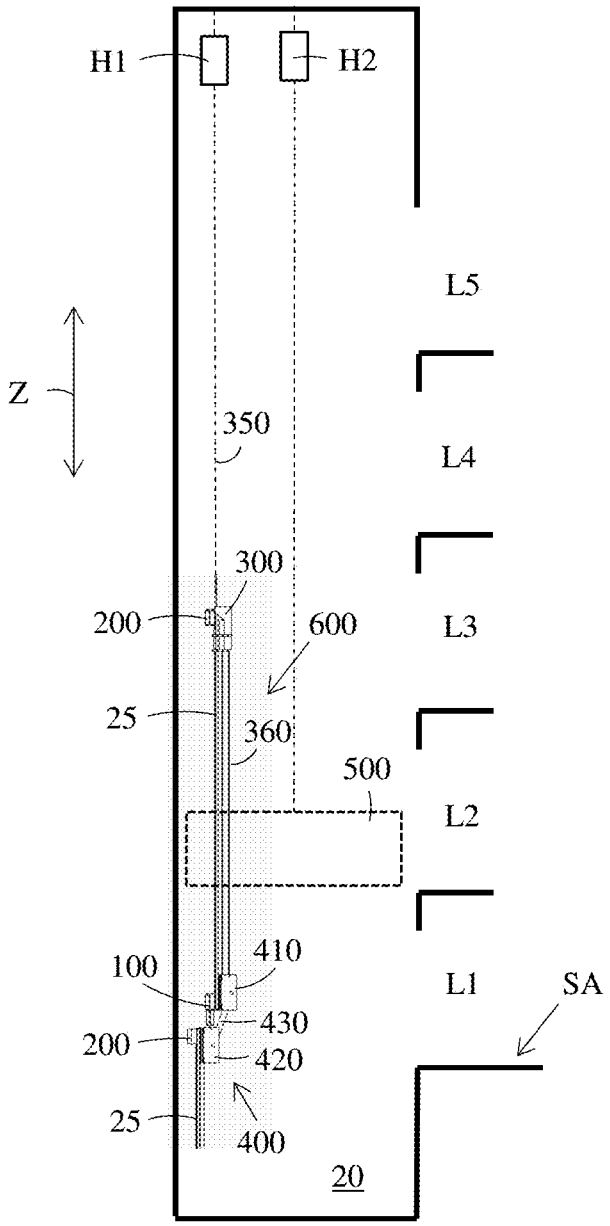
Figure 4:
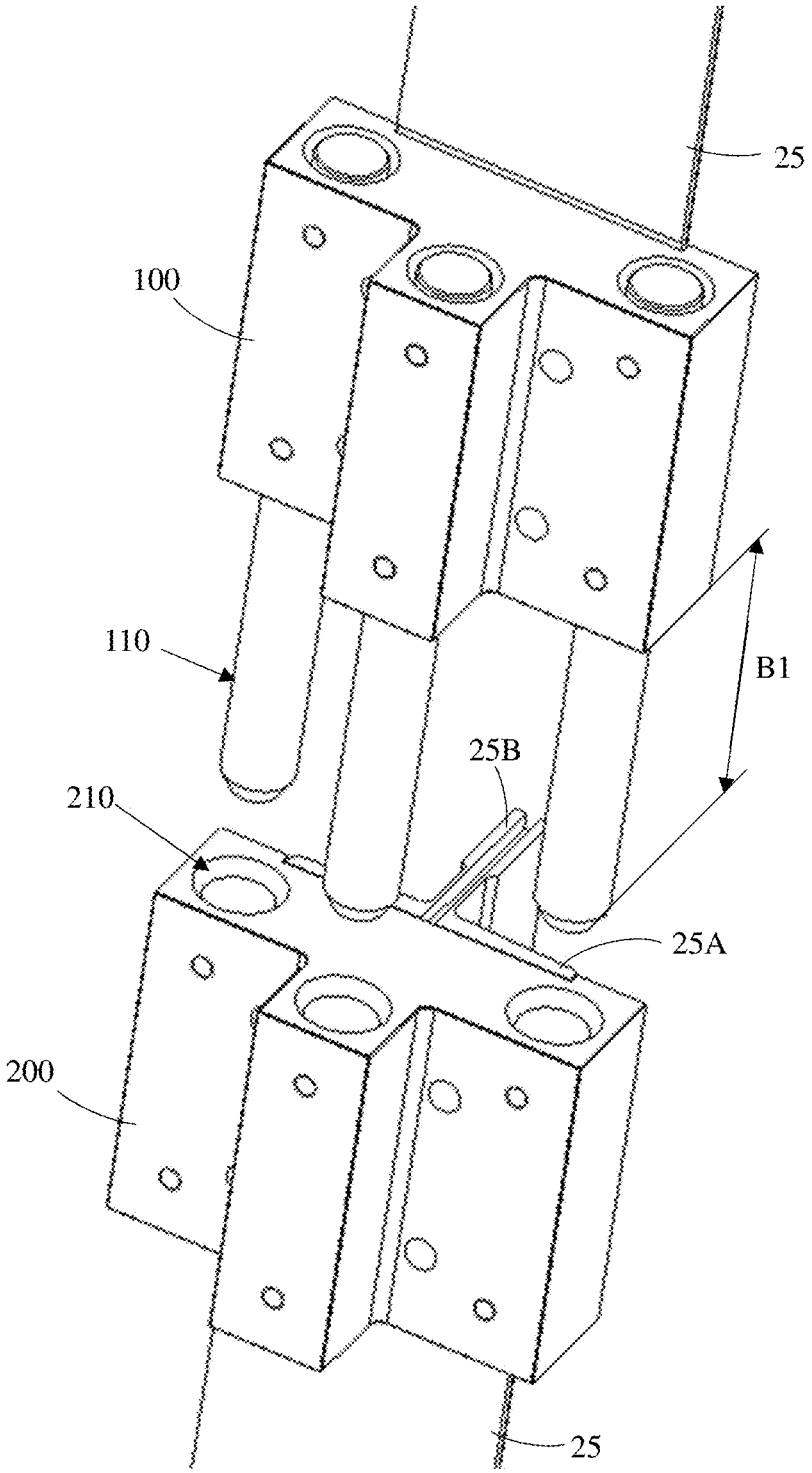
Figure 5:
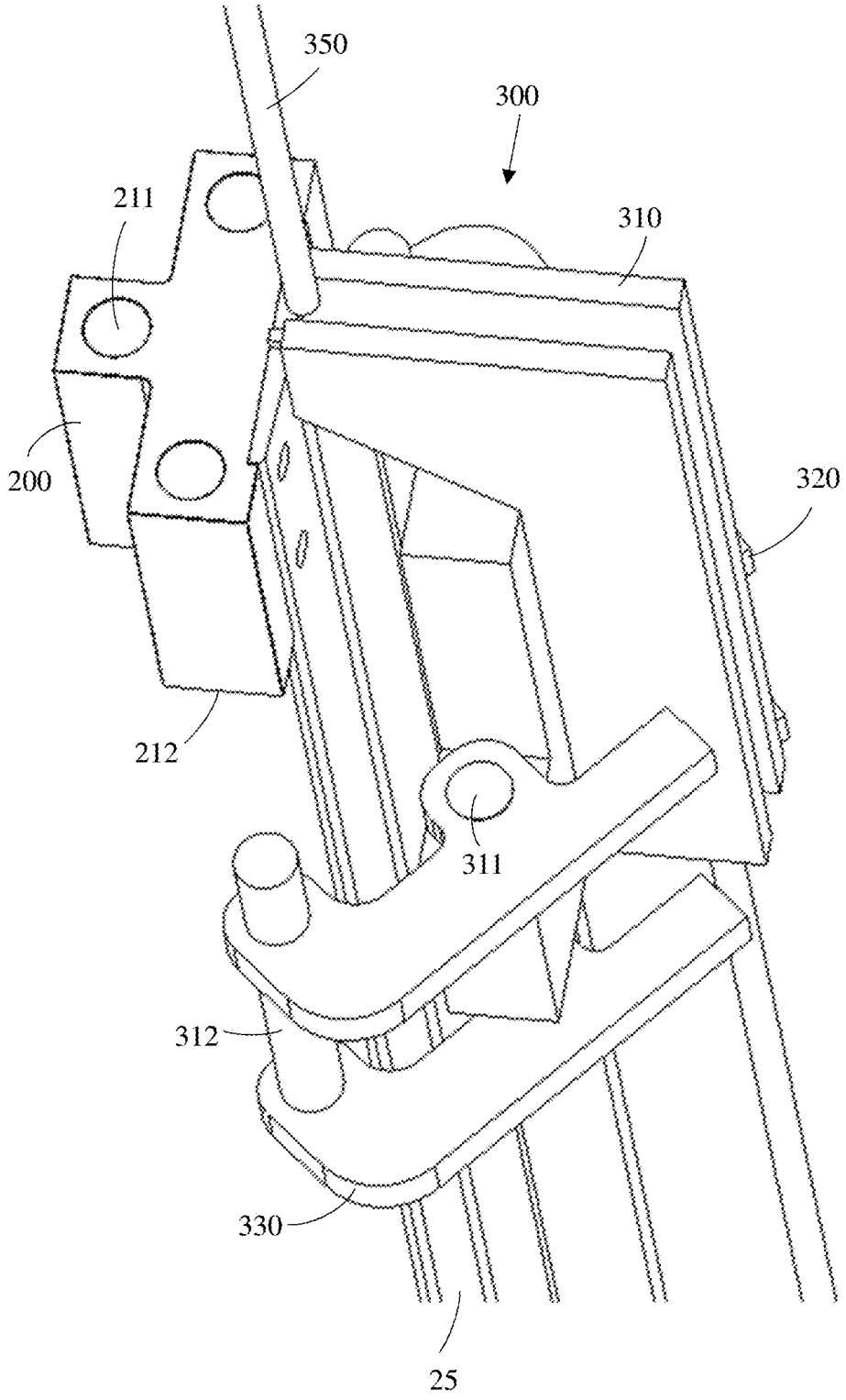
Figure 6:
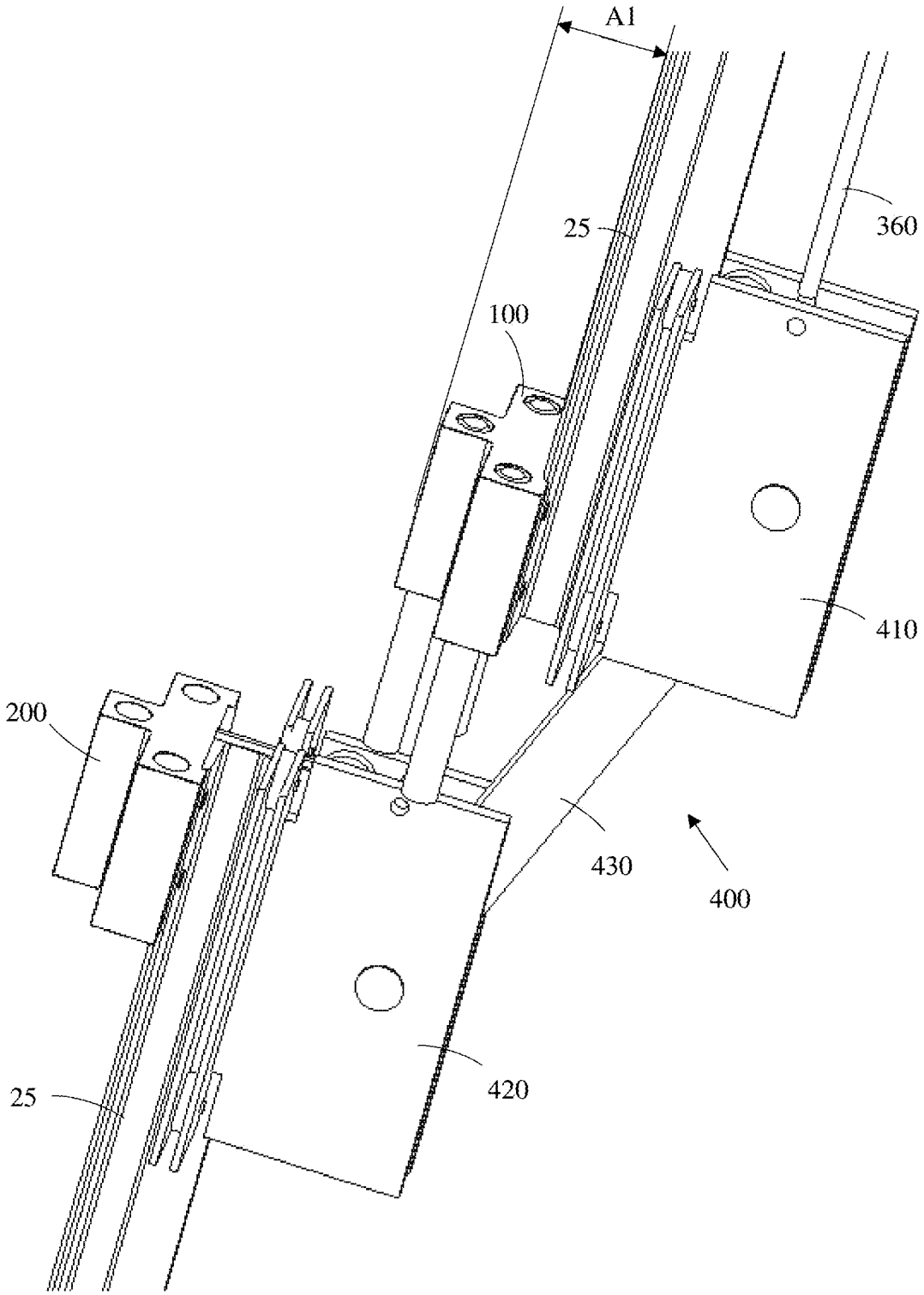
Figure 7:
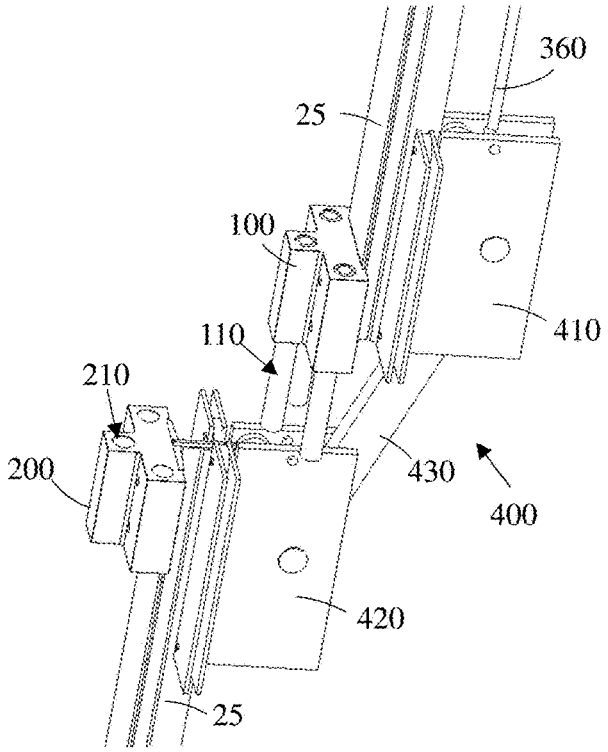
Figure 8:
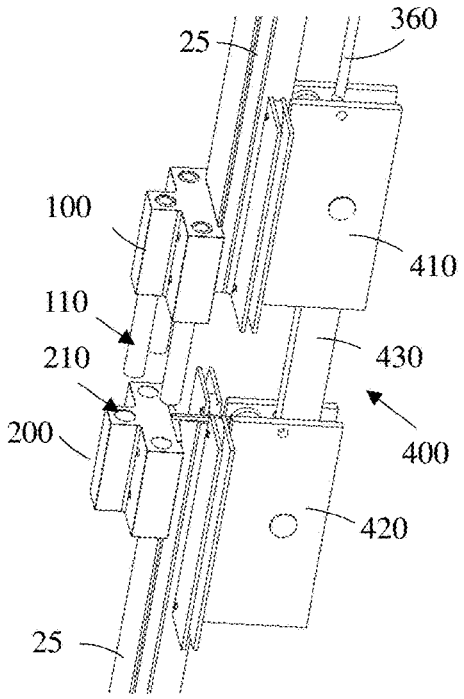
Figure 9:
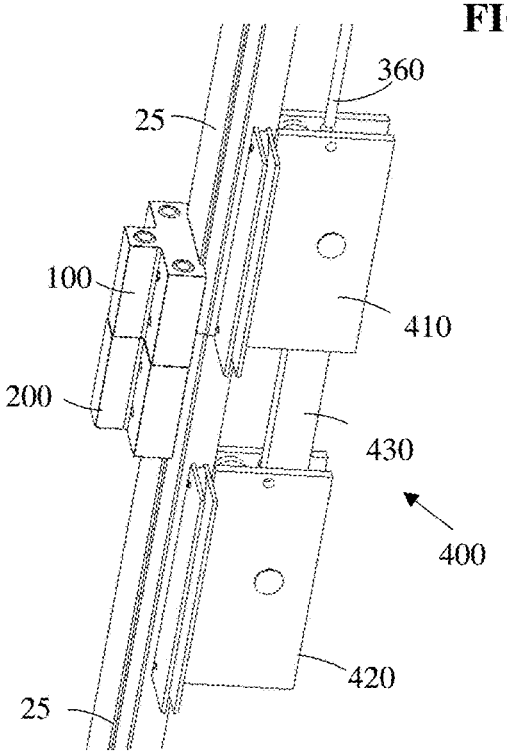
Figure 12:
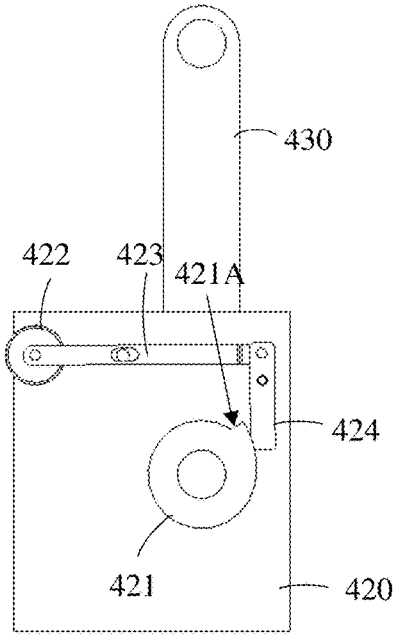
Figure 13:
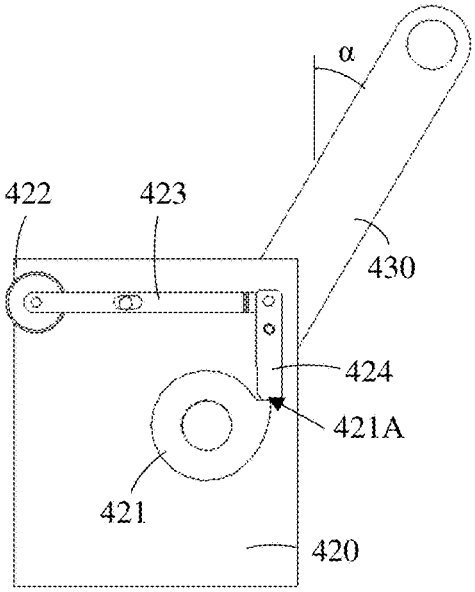
Figure 14:
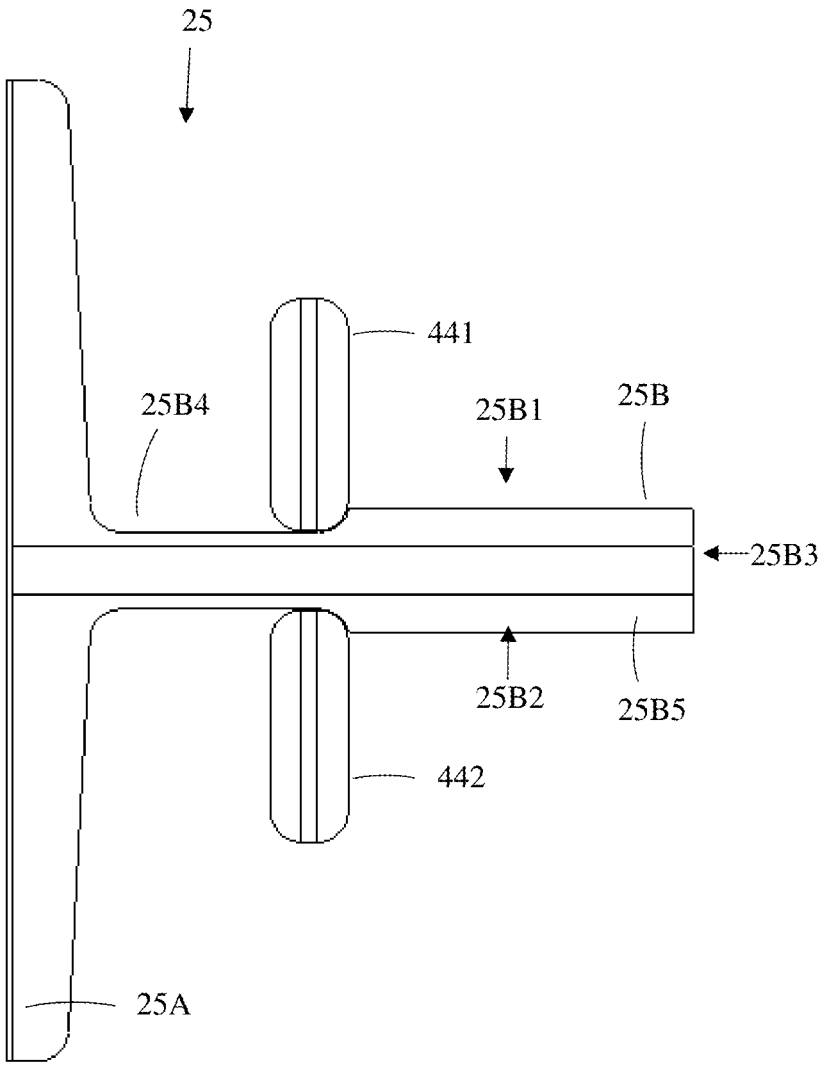
Figure 15:
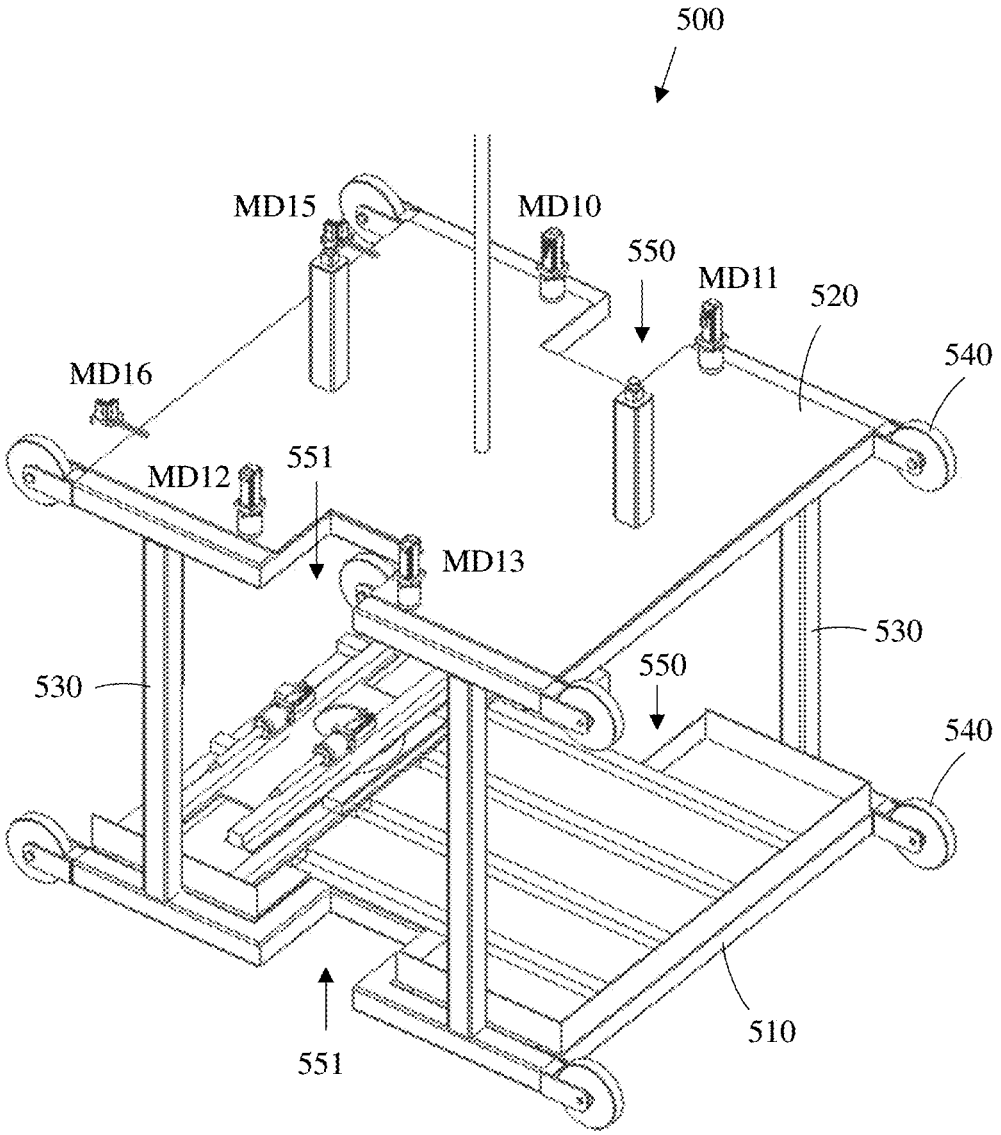
Figure 16:
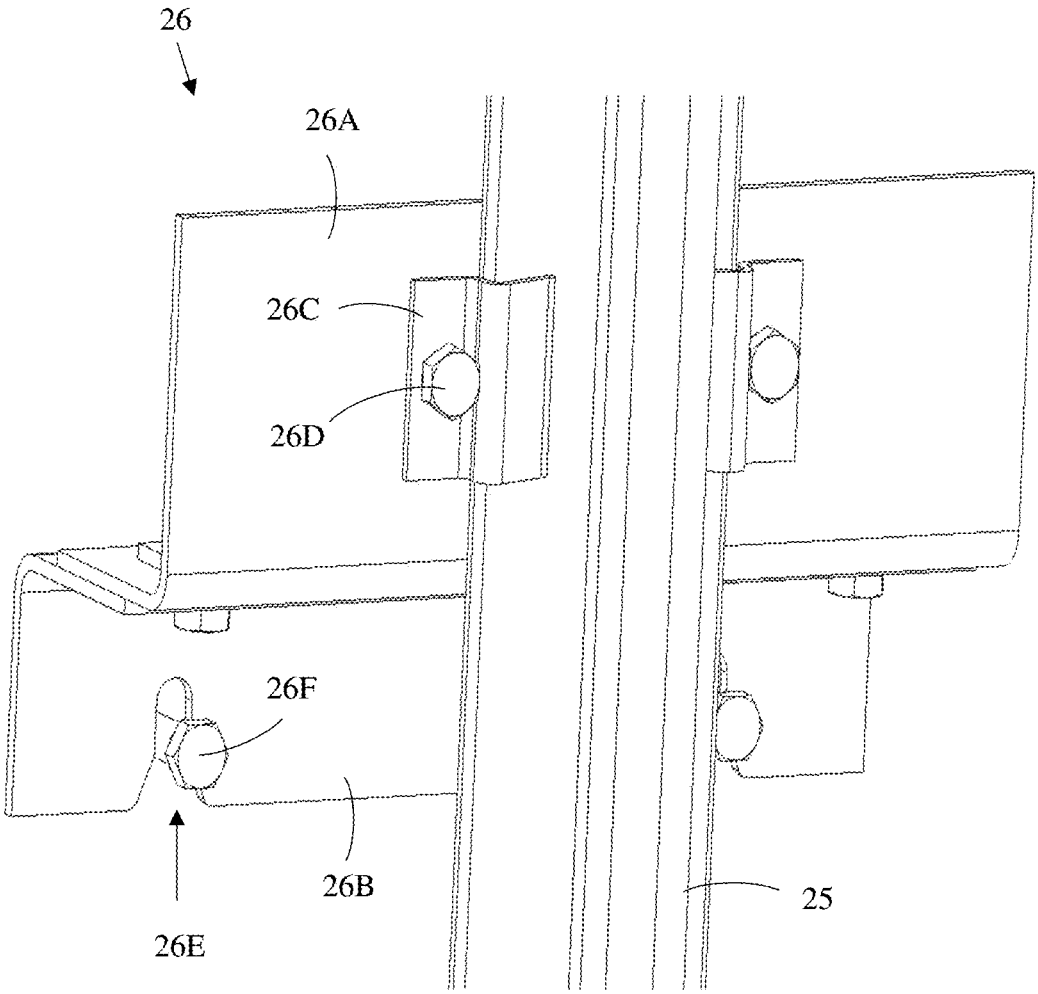

The invention will in the following be described in greater detail by means of preferred embodiments with reference to the attached drawings, in which FIG. 1 shows a side view of an elevator, FIG. 2 shows a horizontal cross section of the elevator, FIG. 3 shows an arrangement for installing guide rails, FIG. 4 shows an arrangement for joining guide rails, FIG. 5 shows a hook device of a transport apparatus, FIG. 6 shows a lever device of a transport apparatus, FIGS. 7-9 show the lever device of the transport apparatus in different positions, FIGS. 10-13 shows the working principle of the lever device, FIG. 14 shows a cross-section of a guide rail, FIG. 15 shows a transport platform, FIG. 16 shows a bracket.

DETAILED DESCRIPTION

FIG. 1 shows a side view and FIG. 2 shows a horizontal cross section of the elevator.

The elevator may comprise a car 10, an elevator shaft 20, hoisting machinery 30, ropes 42, and a counterweight 41. A separate or an integrated car frame 11 may surround the car 10.

The hoisting machinery 30 may be positioned in the shaft 20. The hoisting machinery may comprise a drive 31, an electric motor 32, a traction sheave 33, and a machinery brake 34. The hoisting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with gliding means 27 at guide rails 25 extending in the vertical direction in the shaft 20. The gliding means 27 may comprise rolls rolling on the guide rails 25 or gliding shoes gliding on the guide rails 25 when the car 10 is moving upwards and downwards in the elevator shaft 20. The guide rails 25 may be attached with fastening brackets 26 to the side wall structures 21 in the elevator shaft 20. The gliding means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The wall structure 21 of the shaft 20 may be formed of solid walls 21 or of open beam structure or of any combination of these. One or more of the walls may thus be solid and one or more of the walls may be formed of an open beam structure. The shaft 20 may be comprise a front wall 21A, a back wall 21B and two opposite side walls 21C, 21D. There may be two guide rails 25 for the car 10. The two car guide rails 25 may be positioned on opposite side walls 21C, 21D. There may further be two guide rails 25 for the counterweight 41. The two counterweight guide rails 25 may be positioned on the back wall 21B.

The guide rails 25 may extend vertically along the height of the elevator shaft 20. The guide rails 25 may thus be formed of guide rail elements of a certain length e.g. 5 m. The guide rail elements 25 may be installed end-on-end one after the other. The guide rail elements 25 may be attached to each other with connection plates extending between the end portions of two consecutive guide rail elements 25. The connection plates may be attached to the consecutive guide rail elements 25. The ends of the guide rails 25 may comprise some kind of form locking means in order to position the guide rails 25 correctly in relation to each other. The guide rails 25 may be attached to the walls 21 of the elevator shaft 20 with support means at support points along the height of the guide rails 25.

The car 10 may transport people and/or goods between the landings in the building.

FIG. 2 shows plumb lines PL1, PL2 in the shaft 20, which may be produced by plumbing of the shaft 20 at the beginning of the installation of the elevator. The plumb lines PL1, PL2 may be formed with traditional vires or with light sources e.g. lasers having the beams directed upwards along the plumb lines PL1, PL2. One plumb line and a gyroscope or two plumb lines are normally needed for a global measurement reference in the shaft 20.

FIG. 1 shows a first direction S1, which is a vertical direction in the elevator shaft 20. FIG. 2 shows a second direction S2, which is the direction between the guide rails (DBG) and a third direction S3, which is the direction from the back wall to the front wall (BTF) in the shaft 20. The second direction S2 is perpendicular to the third direction S3. The second direction S2 and the third direction S3 are perpendicular to the first direction S1.

FIG. 3 shows an arrangement for installing guide rails.

The figure shows five landings L1-L5 in the shaft 20, but there could naturally be any number of landings in the shaft 20.

A first hoist H1 may be arranged in the shaft 20 in order to move a transport apparatus 600 upwards and downwards in the shaft 20. The first hoist H1 may be suspended from a ceiling of the shaft 20.

A second hoist H2 may be arranged in the shaft 20 in order to move a transport platform 500 upwards and downwards in the shaft 20. The second hoist H2 may be suspended from the ceiling of the shaft 20.

The transport platform 500 may be supported with rolls on opposite solid walls 21 in the shaft 20. There is no need to connect the transport platform 500 to the guide rails 25 in any way. The transport platform 500 may be used to transport one or more technicians and/or one or more robots and/or tools in the shaft 20. A horizontal cross-section of the transport platform 500 may be provided with passages for the guide rails 25. The transport platform 500 may be used for scanning the shaft before the elevator installation and/or for installing the guide rails to the wall 21 of the shaft 20 and/or for aligning the guide rails 25 after the elevator installation.

A storage area SA may be arranged on the first landing L1. The storage area SA could naturally be arranged at any position below the working level of the guide rail installation. The storage area SA could first be positioned on the first landing L1 and then later relocated to a higher landing as the installation advances. The guide rail elements 25 may be stored on the storage area SA and lifted with the transport apparatus 600. The guide rail elements 25 may be loaded manually on the transport apparatus 600.

A first lowermost section of guide rails 25 may first be installed into the shaft 20 manually. The transport platform 500 may be used in the manual installation of the first section of guide rails 25 to the shaft 20.

The figure shows a situation in which a first guide rail 25 in a second section of guide rails 25 is lifted upwards in the shaft 20 with the transport apparatus 600 connected to the first hoist H1. The transport apparatus 600 may comprise a hook device 300 connected to the first hoist H1 and a lever device 400 connected to the hook device 300. The hook device 300 may be connected with a first wire 350 to the first hoist H1. The lever device 400 may be connected with a second wire 360 to the hook device 300. The lever device 400 may comprise an upper lever part 410 and a lower lever part 420. The upper lever part 410 and the lower lever part 420 may be connected to each other with a lever arm 430.

An upper end of the guide rail element 25 may be attached to the hook device 300 and thereby to the first hoist H1. The hook device 300 may connect to a second jointing clamp 200 attached to an upper end of the guide rail element 25. A first jointing clamp 100 may be attached to a lower end of the guide rail element 25. The jointing clamps 100, 200 may form a plug-in joint between consecutive guide rail elements 25.

A lower end of the guide rail element 25 to be lifted may be attached to the upper lever part 410. The lower lever part 420 may be glidingly supported on the row of already installed guide rail elements 25.

The guide rail element 25 may thus be lifted with the first hoist H1 and the transport apparatus 600 along the row of already installed guide rail elements 25. The upper end of the guide rail element 25 may be firmly attached to the hook device 300. The lifting force is thus transferred from the first hoist H1 to the hook device 300 and further to the guide rail element 25. The lower end of the guide rail element 25 may be attached to the upper lever part 410. The lower lever part 420 may glide on the row of already installed guide rail elements 25. The lower lever part 420 may be glidingly connected to the row of already installed guide rail elements 25 during the upward movement.

The guide rail element 25 may be lifted along the row of already installed guide rail elements 25 to a height in which the lower lever part 420 reaches the upper end of the row of already installed guide rail elements 25.

The guide rail element 25 may then be disconnected from the lever device 400. The lower end of the guide rail element 25 may thereafter be connected to the upper end of the row of already installed guide rail elements 25. The guide rail element 25 may finally be attached to the wall 21 of the shaft 20.

The transport device 600 may thereafter be moved downwards along the row of already installed guide rail elements 25 with the first hoist H1. The hook device 300 and the lever device 400 may glide on the row of already installed guide rail elements 25 when moving downwards. The hook device 300 and the lever device 400 may be glidingly supported of the row of already installed guide rail elements 25.

FIG. 4 shows an arrangement for joining guide rails.

The figure shows a lower end portion of an upper guide rail element 25 and an upper end portion of a lower guide rail element 25. The two guide rail elements 25 are to be joined together.

A cross-section of the guide rail element 25 may have the form of a letter T having a flat bottom portion 25A and a flat support portion 25B protruding outwardly from the middle of the bottom portion 25A. The guide rail element 25 may be attached with brackets to a wall 21 in the shaft 20 from the bottom portion 25A of the guide rail element 25. The support portion 25B of the guide rail element 25 may form two opposite side support surfaces and one end support surface for the support shoes of the car 10 or the counterweight 41. The support shoes may be provided with gliding surfaces or rollers acting on the support surfaces of the support portion 25B of the guide rail element 25.

Each guide rail element 25 may be provided with a first jointing clamp 100 attached to a first end of the guide rail element 25 and a second jointing clamp 200 attached to a second opposite end of the guide rail element 25. The first end of the guide rail element 25 may be the lower end of the guide rail element 25 and the second end of the guide rail element 25 may be the upper end of the guide rail element 25. The figure shows the first jointing clamp 100 on the lower end of the upper guide rail element 25 and the second jointing clamp 200 on the upper end of the lower guide rail element 25.

Each guide rail element 25 may be provided with transverse through holes in the bottom portion of the guide rail element 25 at each end of the guide rail element 25. The first jointing clamp 100 and the second jointing clamp 200 may on the other hand be provided with corresponding threaded holes. Bolts may pass through the holes in the bottom portion in the guide rail element 25 into the threaded holes in the first and the second jointing clamp 100, 200 in order to attach the first and the second jointing clamp 100, 200 to the respective end of the guide rail element 25. The jointing clamps 100, 200 are thus positioned on an opposite surface of the bottom portion of the guide rail 25 in relation to the support portion of the guide rail 25.

A first outer end of the first jointing clamp 100 may be substantially flush with the lower end of the guide rail element 25. The first jointing clamp 100 may comprise male joint elements 110 extending in a longitudinal direction outwards from the first end of the first jointing clamp 100. The longitudinal direction may coincide with the longitudinal direction of the guide rail element 25. The male joint elements 110 may be adapted to pass into corresponding female joint elements 210 in the second jointing clamp 200. The male joint elements 110 may have an equal axial length B1. The axial length B1 of the male joint elements 110 could on the other hand be staggered. The benefit of using male joint elements 110 with a staggered axial length B1 would be to be able to guide the first jointing clamp 100 and the second jointing clamp 200 into a correct position in relation to each other in one direction at a time. The first jointing clamp 100 and the second jointing clamp 200 may be pre-set into correct positions on the guide rail elements 25 before the installation in the shaft 20. The pre-setting is beneficial when using male joint elements 110 with an equal axial length B1.

The male joint elements 110 may be formed of pins. A transverse cross-section of the pins may be circular. The female joint elements 210 may be formed of holes. A transverse cross-section of holes corresponds to the transverse cross-section of the pins.

The number of male joint elements 110 as well as the number of female joint elements 210 is three in this embodiment, but there could be any number of male joint elements 110 in the first jointing clamp 100 and a corresponding number of female joint elements 210 in the second jointing clamp 200. There may thus be at least one male joint element 110 in the first jointing clamp 100 and at least one female joint element 210 in the second jointing clamp 200. The three mail joint elements 110 and the three female joint elements 210 may be positioned in the corners of a triangle.

The number of male joint elements 110 in the first jointing clamp 100 and the number of female joint elements 220 in the second jointing clamp 200 may be equal.

The first jointing clamp 100 and the second jointing clamp 200 may form a plug-in joint between two consecutive guide rail elements 25.

The first jointing clamp 100 may be produced so that through holes are bored in the longitudinal direction of the first jointing clamp 100. The male joint elements 110 are then inserted into the holes and attached in the holes with a pressure joint. There will thus remain blind bored holes extending into the first jointing clamp 100 from the second inner end of the first jointing clamp 100.

A first outer end of the second jointing clamp 200 may be substantially flush with the upper end of the guide rail element 25. The second jointing clamp 200 may comprise holes 210 passing in a longitudinal direction into the second jointing clamp 200 from the first end of the second jointing clamp 200. The longitudinal direction may coincide with the longitudinal direction of the guide rail element 25. The holes 210 may be through holes passing through the second jointing clamp 200.

The two consecutive guide rail elements 25 will be in a correct position in relation to each other when the pins 110 of the first jointing clamp 100 have been pushed fully into the holes 210 of the second jointing clamp 200. The first end surface of the first jointing clamp 100 and the first end surface of the second jointing clamp 200 are then positioned against each other. The opposite surfaces of the two consecutive guide rail elements 25 are also positioned against each other in this position.

The weight of the one or more upper guide rail element 25 will keep the first jointing clamp 100 and the second jointing clamp 200 together. The guide rail elements 25 will naturally also be attached to the wall 21 of the shaft 20 with brackets, whereby movement of the guide rail elements 25 in any direction is eliminated. There is thus probably no need for a separate locking between the first jointing clamp 100 and the second jointing clamp 200. It is naturally possible to provide a separate locking between the first jointing clamp 100 and the second jointing clamp 200 if needed. The locking could be realized as a snap locking between the first jointing clamp 100 and the second jointing clamp 200.

Another possibility would be to provide e.g. the outer end of the middlemost pin 110 with a threading. The middlemost pin 110 could be made long enough so that the outer end of the pin would protrude out from the opposite end of the second jointing clamp 200, when the first jointing clamp 100 and the second jointing clamp 200 are joined together. A nut could then be screwed on the threading in the middlemost pin 110 in order to lock the two jointing clamps 100, 200 together.

The opposite end surfaces of two consecutive guide rail elements 25 may further be provided with a form locking. One end surface could be provided with a groove and the opposite end surface could be provided with a protrusion seating into the groove.

The first jointing clamp 100 and the second jointing clamp 200 may be made of cast iron or of aluminium.

The pins 110 in the first jointing clamp 100 may be made of cold drawn steel bars. The pins 110 could on the other hand also be made of plastic.

The outer ends of the pins 110 in the first jointing clamp 100 may be chamfered in order to facilitate the alignment of the pins 110 into the holes 210 in the second jointing clamp 200.

FIG. 5 shows a hook device of a transport apparatus.

The hook device 300 may comprise a body portion 310 and two locking members 320, 330 pivotably attached to the body portion 310. Each locking member 320, 330 may comprise two parallel rocker arms at a distance from each other. The rocker arms may be pivotably supported via a first shaft 311 on the body portion 310. A second shaft 312 may pass between the outer ends of the rocker arms. The second shaft 312 may protrude upwards from the upper rocker arm. The rocker arms may be spring loaded. The locking members 320, 330 are shown in an open position in the figure. The locking members 320, 330 turn into the locking position when there is tension in the first wire 350 passing to the first hoist H1. The outer ends of the locking members 320, 330 provided with the second shaft 312 will thus turn towards each other so that the outer ends of the second shaft 312 protrude into a respective hole 211, 212 in the second jointing clamp 200 attached to the end of the guide rail element 25.

The locking members 320, 330 will turn into the open position shown in the figure when the tension in the first wire 350 passing to the first hoist H1 is released. The hook 300 will fall downwards so that the outer ends of the second shaft 312 of the locking members 320, 330 falls out from the respective holes 211, 212 in the second jointing clamp 200. The spring means will then push the locking members 320, 330 into the open position shown in the figure.

The hook device 300 may, when the locking members 320, 330 are in the open position, glide along the guide rail 25 downwards when the first hoist H1 unwinds the first wire 350 passing from the first hoist H1 to the hook 300. The weight of the hook device 300 will ensure that the hook device 300 glides downwards along the guide rail 25 when the first support wire 350 is unwounded from the first hoist H1.

FIG. 6 shows a lever device of a transport apparatus.

The lever device 400 comprises an upper lever part 410 and a lower lever part 420. The lower lever part 420 glides on the already installed guide rail 25. The upper lever part 410 receives a lower end of the guide rail element 25 to be lifted. The upper lever part 410 is connected to the lower lever part 420 via a lever arm 430.

FIG. 6 shows the lever device 400 during the lifting of the guide rail element 25. The lower lever part 420 of the lever device 400 glides on the guide rail 25 that have already been installed to the wall 21 of the shaft 20. The lower end of the guide rail element 25 to be lifted is supported on the upper lever part 410 of the lever device 400. The lever arm 430 may be pivotably attached to the upper lever part 410 and to the lower lever part 420 of the lever device 400. The lever arm 430 is shown in an inclined position forming a first operational position. The lever arm 430 may be locked in this first operational position so that the guide rail element 25 to be lifted is kept at a distance from the guide rail 25 that has already been installed to the wall 21 of the shaft 20. The upper lever part 410 is at a distance A1 from the row of already installed guide rail elements 25. This distance A1 leaves room for the guide rail element 25 provided with the first jointing clamp 100 to pass on the outer side of the row of already installed guide rail elements 25 when the guide rail element 25 is lifted.

FIGS. 7-9 show the lever device of the transport apparatus in different positions.

The first hoist H1 may be connected with a first wire 350 to the transport apparatus 600 i.e. to the hook device 300 of the transport apparatus 600 positioned at the upper end of the transport apparatus 600. The lever device 400 of the transport apparatus 600 may be connected with a second wire 360 to the hook device 300. (see FIG. 3).

FIG. 7 shows the lever device 400 in a position in which the lever device 400 has just reached the upper end of the already installed guide rail elements 25.

FIG. 8 shows the lever device 400 in a position in which the lower part 420 of the lever device has stopped at the upper end of the already installed guide rail 25. The locking of the lever arm 430 has been released and the lever arm 430 has been stretched out into a straight position in relation to the longitudinal direction of the already installed guide rail elements 25.

FIG. 9 shows the lever device 400 in a position in which the lever device 400 has moved downwards so that the pins 110 in the first jointing clamp 100 have been pushed into the respective holes 210 in the second jointing clamp 200.

FIGS. 10-13 shows the working principle of the lever device.

The figures show the lower part 420 and the lever arm 430 of the lever device 400. The upper lever part 410 of the lever device 400 is not shown for clarity reasons.

Both ends of the lever arm 430 may be pivotably supported with a pivot joint J1, J2 in the respective lever part 410, 420 of the lever device 400.

The lever arm 430 may be pivotably supported via a first shaft in the lower lever part 420 of the lever device 400. The first shaft may further pass through a locking part 421 positioned under the lever arm 430 in the lower lever part 420 of the lever device 400. The lever arm 430 and the locking part 421 may be fixedly attached to the first shaft. The first shaft may on the other hand be rotatably supported in the upper lever part 420 of the lever device 400.

A roller 422 may be rotatably supported on a first end of a first support arm 423. The outer perimeter of the roller 422 may protrude out from the lower lever part 420 so that the roller 422 may roll on the guide rail 25. The second opposite end of the first support arm 423 may be attached with a third pivot joint J3 to a first end of a second support arm 424. The second support arm 424 may be pivotably supported with a fourth pivot joint J4 in the lower lever part 420 of the lever device 400. The second opposite end of the second support arm 424 may lean on a locking surface 421A provided on the locking part 421. The second support arm 424 may be spring loaded. A spring may be positioned in the fourth pivot joint J4.

A guide pin 423A may be provided in the lower lever part 420 of the lever device 400. The guide pin 423A may extend through a guide opening in the first support arm 423. The guide opening in the first support arm 423 may be formed of an oblong hole in the first support arm 423. The longitudinal movement of the first support arm 423 is thus guided by the guide pin 423A.

Figure 10:
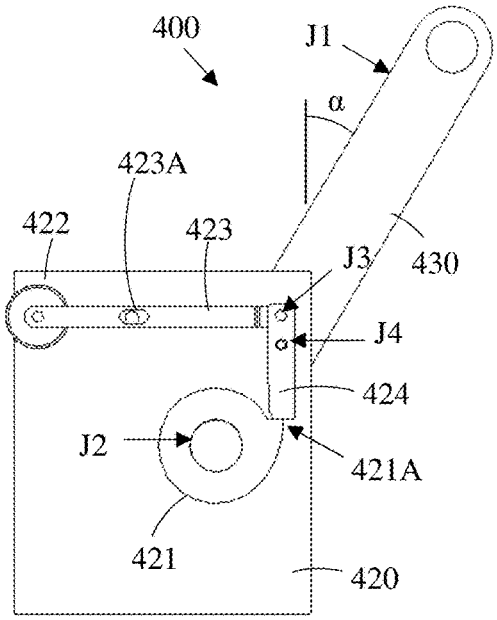

FIG. 10 shows a situation in which the guide rail element 25 is lifted upwards i.e. the lever device 400 moves upwards and keeps the rail element 25 to be lifted at a distance from the already installed rail elements 25. The lever arm 430 is locked in the inclined position. The lever arm 430 forms an angle $\alpha$ with the vertical direction. The roller 422 rolls against the guide rail 25, whereby the first support arm 423 is pushed to the right in the figure. The second end of the second support arm 424 leans against the locking surface 421A in the locking part 421. Rotation of the locking part 421 in a counter-clockwise direction is thus prohibited. A stopper may further be provided in the lower lever part 420 of the lever device 400 in order to eliminate further rotation of the locking part 421 in a clockwise direction from the position shown in the figure.

Figure 11:
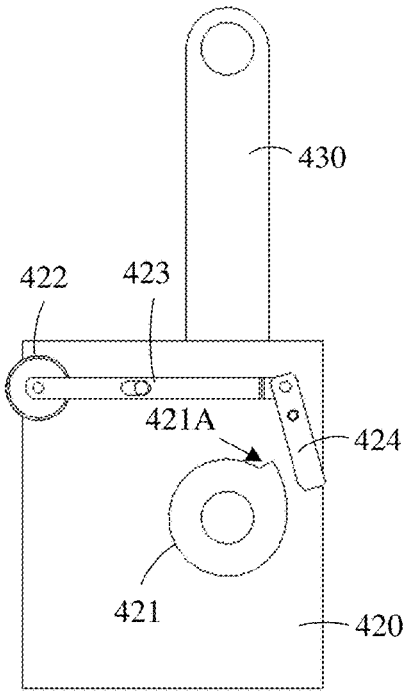

FIG. 11 shows a situation in which the lever device 400 has reached the upper end of the row of already installed guide rail elements 25. The roller 422 passes beyond the upper end of the row of already installed guide rail elements 25, whereby the roller 422 is free to move to the left in the figure. The spring load in the second support arm 424 will turn the second support arm 424 in a counter-clockwise direction around the fourth pivot joint J4, whereby the first support arm 423 pushes the roller 422 to the left. Rotation of the second support arm 424 in a counter-clockwise direction around the fourth pivot joint J4 will move the second end (the lower end) of the second support arm 424 to the right in the figure. The second end of the second support arm 424 is thus moved away from the locking surface 421A on the locking part 421. The locking part 421 is thus released to rotate in the counter-clockwise direction, whereby the lever arm 430 may move into a straight position when an upward directed force is acting on the lever arm 430.

FIG. 12 shows a situation in which the lever device 400 is moving downwards on the row of already installed guide rail elements 25. The roller 422 rolls on the guide rails 25 and pushes the first support arm 423 to the right in the figure. The second support arm 424 is thus turned in a clockwise direction against the spring force into a substantially vertical position in the figure. The second end of the second support arm 424 is leaning on the outer surface of the locking member 421. The lever arm 430 is still in a straight position i.e. the upper lever part 410 is positioned in a straight line above the lower lever part 420 of the lever device 400. The upper lever part 410 and the lower lever part 420 of the lever device 400 are thus gliding on the row of already installed guide rail elements 25.

FIG. 13 shows a situation in which the lever device 400 reaches the bottom of the row of already installed guide rail elements 25. The lower lever part 420 of the lever device 400 stops and the weight of the upper lever part 410 turns the lever arm 430 into the inclined position. The locking member 421 is thus turned in a clockwise direction, whereby the second end of the second support arm 424 becomes again seated on the locking surface 421A of the locking member 421. The stopper limits the turning of the locking member 421 to the position shown in the figure. A new guide rail member 25 may again be attached to the hook device 300 and to the lever device 400 in order to be transported upwards in the shaft 20.

FIG. 14 shows a cross-section of a guide rail.

A cross-section of the guide rail element 25 may have the form of a letter T having a flat bottom portion 25A and a flat support portion 25B protruding outwardly from the middle of the bottom portion 25A. The guide rail element 25 may be attached with brackets to a wall 21 in the shaft 20 from the bottom portion 25A of the guide rail element 25. The support portion 25B of the guide rail element 25 may form two opposite side support surfaces 25B1, 25B2 and one end support surface 25B3 for the support shoes of the car 10 or the counterweight 41. The support shoes may be provided with gliding surfaces or rollers acting on the support surfaces 25B1, 25B2, 25B3 of the support portion 25B of the guide rail element 25.

The hook device 300 and the lever device 400 i.e. the upper lever part 410 and the lower lever part 420 may be provided with rollers 441, 442 or gliding shoes rolling or gliding on the inner thinner portion 25B4 of the support portion 25B of the guide rail 25. The rollers 441, 442 or gliding shoes may be positioned in the transition between the lower thinner portion 25B4 and the outer thicker portion 25B5 of the support portion 25B of the guide rail 25. The rollers 441, 442 in the hook device 300 will keep the hook device 300 secured to the guide rail 25 during the downwards movement of the hook device 300 on the guide rail 25. The rollers 441, 442 in the lower lever part 420 will keep the lever device 400 secured to the guide rail 25 during the upwards and downwards movement of the lever device 400 on the guide rail 25. The rollers 441, 442 in the upper lever part 410 will keep the lower end of the guide rail element 25 secured to the upper lever part 410 during the upwards movement of the transport device 600 on the guide rail 25.

The rollers 441, 442 may be movably supported in the hook device 300 and in the lever device 400. The rollers 441, 442 may be moved between a first position in which the rollers 441, 442 are in contact with the guide rail 25 as seen in the figure and a second position in which the rollers 441, 442 are out of contact from the guide rail 25. The hook device 300 and the lever device 400 may be disconnected from the guide rail 25 when the rollers 441, 442 are in the second position.

FIG. 15 shows a transport platform.

The transport platform 500 may comprise a bottom plane 510 and a roof plane 520 positioned at a vertical distance above the bottom plane 510. The bottom plane 510 may form a work surface for one or more technicians and/or for one or more robots. Vertical support bars 530 may extend between the bottom plane 510 and the roof plane 520. Two support rollers 540 are provided at opposite ends in each plane 510, 520 in the transport platform 500. The support rollers 540 support the transport platform 500 on opposite walls 21 in the shaft 20. The support rollers 540 keep the transport platform 500 substantially in a horizontal plane when the transport platform 500 is moved upwards and downwards in the shaft 20. The transport platform 500 may further be provided with locking means for locking the transport platform to the walls 21 in the shaft 20. The locking means could be realized with hydraulic cylinders acting against two opposite walls 21 in the shaft 20.

By-pass passages 550, 551 for guide rail elements 25 to be lifted during the installation of the guide rails 25 may further be formed in the transport platform 500. The by-pass passages 550, 551 may be formed of recesses protruding inwards from a perimeter of the transport platform 500. The by-pass passages 550, 551 also provide space for the plumb lines PL1, PL2 to by-pass the transport platform 500.

The transport platform 500 may be provided with measuring devices MD10, MD11, MD12, MD13 for measuring the position of the transport platform 500 in relation to the shaft 20. The measuring devices MD10, MD11, MD12, MD13 may determine the position of the transport platform 500 in the shaft 20 based on the plumb lines PL1, PL2 once the transport platform 500 is locked in the shaft 20. The measuring devices MD10, MD11, MD12, MD13 can be based on a sensor measuring without contact the position of the plumb lines PL1, PL2 being formed of wires. Another possibility is to use light sources e.g. lasers on the bottom of the elevator shaft producing upwards directed light beams that can be measured with the measuring devices MD10, MD11, MD12, MD13 on the transport platform 500. The measuring devices MD10, MD11, MD12, MD13 could be light sensitive sensors or digital imaging devices measuring the hit points of the light beams produced by the light sources. The light source could be a robotic total station, whereby the measuring devices MD10, MD11, MD12, MD13 would be reflectors reflecting the light beams back to the robotic total station. The robotic total station would then measure the position of the measuring devices MD10, MD11, MD12, MD13.

The transport platform 500 may further be provided with distance measurement devises MD15, MD16 for measuring the vertical position i.e. the height position of the transport platform 500 in the shaft 20. The distance measurement may be based on a laser measurement.

FIG. 16 shows a bracket.

The bracket 26 may be formed of two separate parts 26A, 26B that are movably attached to each other. A first part 26A of the bracket 26 may be attached to the guide rail 25 and a second part 26B of the bracket 26 may be attached to a wall 21 in the shaft 20. The first part 26A and the second part 26B may have the shape of a letter L with a vertical portion and a horizontal portion. The first part 26A may be attached from the vertical portion with clamp 26C and a bolt 26D to the guide rail 25. The second part 26B may be attached from the vertical portion to the wall 21 in the shaft 20. The horizontal portions of the first part 26A and the second part 26B of the bracket 26 may be attached each other with bolts passing through openings in said horizontal portions of the first part 26A and the second part 26B of the bracket 26. The openings may be dimensioned so that it is possible to fine adjust the position of the first part 26A in relation to the second part 26B of the bracket 26 in order to be able to align the guide rails 25.

The second part 26B of the bracket 26 may be attached to the wall in the shaft 20 with anchor bolts 26F. The vertical portion in the second part 26B of the bracket 26 may comprise oblong openings 26E being open at the lower end of the vertical portion in the second part 26B. Holes for the anchor bolts 26F may be drilled into the walls 21 of the shaft 20 at predetermined positions already before the installation of the guide rails 25 is started. Anchor bolts 26F may be screwed into the holes. The bolts 26F may be screwed only partly into the threading so that the head of the bolts 26F is at a distance from the fastening surface.

The brackets 26 may be installed into predetermined positions on the guide rail elements 25 to be installed already before the guide rail elements 25 to be installed are lifted in the shaft 20.

The brackets 26 that have been attached to the guide rail elements 25 already before the guide rails elements 25 are lifted will then become positioned just above the bolts 26F when the lever arm 430 turns to the second operational position. Lowering of the guide rail element 25 to be installed will also lower the brackets 26 attached to the guide rail element 25 so that the oblong openings 26E glide on the bolts 26F.

Tightening of the bolts 26F will attach the second part 26B of the bracket 26 to the wall 21 in the shaft 20. The bolts 26F may be tightened from the transport platform 500 manually by a technician or with a robot.

Another possibility would be to drill the anchor holes during the installation of the guide rails 25. This could be done manually or automatically from the transport platform 500.

The jointing clamps 100, 200 may be adjusted e.g. by shimming and/or grinding into exactly correct positions when they are attached to the ends of the guide rail element 25. The jointing clamps 100, 200 will thus be in a correct position on the guide rail elements 25 when the guide rail elements 25 are installed to the shaft 20.

The guide rails 25 may be aligned after they have been installed to the respective walls 21 in the shaft 20. The alignment of the guide rails 25 may be done by in any known manner.

The figures show an embodiment in which only one first hoist H1 with a transport device 600 is used. The suspension point for the first hoist H1 would have to be changed during the installation. Each row of guide rail elements 25 to be installed would need a suspension point of their own for the first hoist H1. Several first hoists H1 could naturally be suspended from the ceiling of the shaft 20. Each first hoist H1 would thus be provided with a transport device 600 of its own. This would mean that several rows of guide rails 25 could be installed simultaneously into the shaft 20.

The shaft 20 in the figures is intended for only one car 10, but the invention could naturally be used in shafts intended for several cars 10. Such elevator shafts 10 could be divided into sub-shafts for each car 10 with steel bars. Horizontal steel bars could be provided at predetermined intervals along the height of the shaft 20. A part of the guide rails 25 would then be attached to the steel bars in the shaft 20. Another part of the guide rails 25 would be attached to solid walls 21 in the shaft 20.

The invention may be used in low rise or in high rise buildings. The benefits of the invention are naturally greater in high rise buildings. High rise buildings may have a hoisting height over 75 meters, preferably over 100 meters, more preferably over 150 meters, most preferably over 250 meters.

The use of the invention is not limited to the elevator disclosed in the figures. The invention can be used in any type of elevator e.g. an elevator comprising a machine room or lacking a machine room, an elevator comprising a counterweight or lacking a counterweight. The counterweight could be positioned on either side wall or on both side walls or on the back wall of the elevator shaft. The drive, the motor, the traction sheave, and the machine brake could be positioned in a machine room or somewhere in the elevator shaft. The car guide rails could be positioned on opposite side walls of the shaft or on a back wall of the shaft in a so called ruck-sack elevator.

It will be obvious to a person skilled in the art that, as the technology advances, the inventive concept can be implemented in various ways. The invention and its embodiments are not limited to the examples described above but may vary within the scope of the claims.

The invention claimed is:

1. A method for installing guide rails into an elevator shaft, said method comprising installing manually a lowermost first section of guide rail elements to respective walls of the shaft, arranging a first hoist for moving a transport apparatus upwards and downwards in the shaft, the transport apparatus comprising a hook device connected to the first hoist and a lever device connected to the hook device, each guide rail element being provided with a first jointing clamp attached to a lower end of the guide rail element and a second jointing clamp attached to an upper end of the guide rail element, the first jointing clamp and the second jointing clamp forming a plug-in joint between two consecutive guide rail elements, arranging a second hoist for moving a transport platform upwards and downwards in the shaft, connecting a guide rail element to the transport apparatus so that the second jointing clamp at the upper end of the guide rail is connected to the hook device and the lower end of the guide rail element is connected to the lever device, moving the transport apparatus and thereby also the guide rail element upwards with the first hoist, the lever device gliding on the row of already installed guide rail elements, connecting the guide rail element to an upper end of the row of already installed guide rail elements with the plug-in joint provided by the first jointing clamp and the second jointing clamp, attaching the guide rail element to a wall of the shaft from the transport platform, moving the transport apparatus downwards with the first hoist in order to fetch a new guide rail element, the hook device and the lever device gliding on the row of already installed guide rail elements.

2. The method according to claim 1, wherein the first jointing clamp comprises at least one male joint element and the second jointing clamp comprises at least one female joint element or vice a versa, the male joint element and the female joint element forming the plug-in joint between the first jointing clamp and the second jointing clamp and thereby between two consecutive guide rail elements when the first jointing clamp and the second jointing clamp are connected to each other.

3. The method according to claim 2, wherein the male joint element is formed of a pin and the female joint element is formed of a hole receiving the pin.

4. The method according to claim 1, wherein the lever device comprises an upper lever part, a lower lever part and a lever arm having a first end pivotably attached to the upper lever part and a second opposite end pivotably attached to the lower lever part, the lower lever part being glidingly supported on the row of already installed guide rail elements and the lower end of the guide rail element being supported on the upper lever part.

5. The method according to claim 4, wherein the lever arm has a first operational position in which the lever arm is inclined making the upper lever part and the lower lever part staggered in relation to each other so that the upper lever part is at a horizontal distance from the row of already installed guide rail elements leaving space for the lower end of the guide rail element with the first jointing clamp, and a second operational position in which the lever arm is straight so that the upper lever part and the lower lever part are in line with each other.

6. The method according to claim 5, wherein the lever arm is in the first operational position when the guide rail element is moved upwards along the row of already installed guide rail elements.

7. The method according to claim 5, wherein the lever arm changes to the second operational position when the lower lever part reaches the upper end of the row of already installed guide rail elements making the first jointing clamp and the second jointing clamp in line with each other, whereby lowering of the guide rail element results in that the plug-in joint between the first and the second jointing clamp closes joining the guide rail element to the uppermost guide rail element in the row of already installed guide rail elements.

8. An arrangement for installing guide rails into an elevator shaft, said arrangement comprising:

a lowermost first section of guide rail elements installed to respective walls of the shaft, a transport apparatus moving upwards and downwards in the shaft with a first hoist, the transport apparatus comprising a hook device connected to the first hoist and a lever device connected to the hook device, each guide rail element being provided with a first jointing clamp attached to a lower end of the guide rail element and a second jointing clamp attached to an upper end of the guide rail element, the first jointing clamp and the second jointing clamp forming a plug-in joint between two consecutive guide rail elements, a transport platform moving upwards and downwards in the shaft with a second hoist, whereby a guide rail element is connected to the transport apparatus so that the second jointing clamp at the upper end of the guide rail element is connected to the hook device and the lower end of the guide rail element is connected to the lever device, the transport apparatus and thereby also the guide rail element is moved upwards with the first hoist, the lever device gliding on the row of already installed guide rail elements, the guide rail element is connected to an upper end of the row of already installed guide rail elements with the plug-in joint provided by the first jointing clamp and the second jointing clamp, the guide rail element is attached to a wall of the shaft from the transport platform, the transport apparatus is moved downwards in order to fetch a new guide rail element, the hook device and the lever device gliding on the row of already installed guide rail elements.

9. The arrangement according to claim 8, wherein the first jointing clamp comprises at least one male joint element and the second jointing clamp comprises at least one female joint element or vice a versa, the male joint element and the female joint element forming the plug-in joint between the first jointing clamp and the second jointing clamp and thereby between two consecutive guide rail elements when the first jointing clamp and the second jointing clamp are connected to each other.

10. The arrangement according to claim 9, wherein the male joint element is formed of a pin and the female joint element is formed of a hole receiving the pin.

11. The arrangement according to claim 8, wherein the lever device comprises an upper lever part, a lower lever part and a lever arm having a first end pivotably attached to the upper lever part and a second opposite end pivotably attached to the lower lever part, the lower lever part being glidingly supported on the row of already installed guide rail elements and the lower end of the guide rail element being supported on the upper lever part.

12. The arrangement according to claim 11, wherein the lever arm has a first operational position in which the lever arm is inclined making the upper lever part and the lower lever part staggered in relation to each other so that the upper lever part is at a horizontal distance from the row of already installed guide rail elements leaving space for the lower end of the guide rail element with the first jointing clamp, and a second operational position in which the lever arm is straight so that the upper lever part and the lower lever part are in line with each other.

13. The arrangement according to claim 12, wherein the lever arm is in the first operational position when the guide rail element is moved upwards along the row of already installed guide rails.

14. The arrangement according to claim 12, wherein the lever arm changes to the second operational position when the lower lever part reaches the upper end of the row of already installed guide rail elements making the first jointing clamp and the second jointing clamp in line with each other, whereby lowering of the guide rail element results in that the plug-in joint between the first and the second jointing clamp closes joining the guide rail element to the uppermost guide rail element in the row of already installed guide rail elements.

* * * * *